United States Patent [19]

Zador et al.

[11] Patent Number: 5,011,513

[45] Date of Patent: Apr. 30, 1991

[54] SINGLE STEP, RADIATION CURABLE OPHTHALMIC FINING PAD

[75] Inventors: Eugene Zador, Ballston Lake; Shyiguei Hsu, Watervliet; Wesley R. Kaczmarek, Ballston Lake; Sitaramaiah Ravipati, Latham; Stanley Supkis, Averill Park; Richard H. Vogel, Saratoga Springs, all of N.Y.

[73] Assignee: Norton Company, Worcester, Mass.

[21] Appl. No.: 359,164

[22] Filed: May 31, 1989

[51] Int. Cl.[5] ..... B24D 11/00

[52] U.S. Cl. ..... 51/295; 51/293; 51/298

[58] Field of Search ..... 51/293, 295, 298

[56] References Cited

U.S. PATENT DOCUMENTS

| | | | |
|---|---|---|---|
| 3,806,327 | 4/1974 | Farmer et al. | 51/295 |
| 4,047,903 | 9/1977 | Hesse et al. | 51/298 |
| 4,072,592 | 2/1978 | Due et al. | 204/159.15 |
| 4,082,634 | 4/1978 | Chang | 204/159.15 |
| 4,457,766 | 7/1984 | Caul | 51/298 |
| 4,476,189 | 10/1984 | Posey | 428/336 |
| 4,574,204 | 10/1985 | Caul | 51/298 |
| 4,588,419 | 5/1986 | Caul et al. | 51/295 |
| 4,629,473 | 12/1986 | Ruid et al. | 51/295 |
| 4,642,126 | 2/1987 | Zador et al. | 51/295 |
| 4,644,703 | 2/1987 | Kaczmarek et al. | 51/401 |
| 4,773,920 | 9/1988 | Chasman et al. | 51/295 |
| 4,828,583 | 5/1989 | Oxman et al. | 51/295 |
| 4,836,832 | 6/1989 | Tumey et al. | 51/293 |
| 4,903,440 | 2/1990 | Larson et al. | 51/298 |
| 4,927,431 | 5/1990 | Buchanan et al. | 51/298 |

*Primary Examiner*—William R. Dixon, Jr.
*Assistant Examiner*—Willie J. Thompson
*Attorney, Agent, or Firm*—Arthur A. Loiselle

[57] ABSTRACT

A single step fining pad for use in a ophthalmic applications having radiation cured maker and size coats of different hardnesses.

23 Claims, 1 Drawing Sheet

SINGLE STEP, RADIATION CURABLE OPHTHALMIC FINING PAD

BACKGROUND OF THE INVENTION

1.Field of the Invention

This invention relates, in general, to coated abrasive material. More particularly, it relates to novel coated abrasive material suitable for use in a single step fining pad in ophthalmic applications.

2. Technical Background and Prior Art

The term "fining" is an established term in the ophthalmic art. A description of the fining process and of suitable machinery for accomplishing it are disclosed in U.S. Pat. No. 3,732,647 (to Stith) and U.S. Pat. No. 4,320,599 (to Hill et al), the complete specifications and drawings of which are herein incorporated by reference. Stith discloses in FIG. 2 of the patent, a lapping tool such as envisioned by one aspect of the instant invention. The lapping surface 78 of the tool provided in Stith may be a coated abrasive material consisting of abrasive grains adhered to a flexible backing which, in turn, is supported by the structure disclosed in Stith.

When "ophthalmic lens fining" is performed on a Coburn-505 fining machine with coated abrasive material, however, it can refer to either a "one-step" process or a "two-step" operation. In one-step (or single step) fining, a single daisy wheel or film backed fining pad ("Snowflake") is employed before the final slurry-polishing step. Such a pad is capable of removing relatively large amounts (0.4–0.6 mm) of excess stock and, at the same time, generate a sufficiently fine, scratch-free surface. In the more conventional two-step fining operation, a silicon carbide (600 grit) coated abrasive product (a first fining pad) is used first which removes most of the surplus stock. This is followed then by use of a second fining pad, a much finer grain aluminum oxide based, coated abrasive product. This second pad removes little stock (0.03–0.05 mm) but has fine finishing capabilities. Preference for the one-step or the two-step process heretofor has depended upon a number of factors, including the lens type to be ground (glass, CR-39 plastic and polycarbonate are the three most common lens types), the lense curvature (diopter), shape (cylindrical and spherical), and lens size.

Nevertheless, whether the one- or two- step process is used, the main objective of lens fining is to prepare the optical lens for the final or slurry polishing step which is usually performed with slurries of various small particle size aluminum oxide (0.5–1.0 micron range). As a consequence of such low particle size, the slurries cannot remove deep scratches (Rt values greater than, say, 50–70 microns) from lenses obtained during the fining process. Thus, there is always a need for fining products that better improve the results of the fining or prefinishing process so as to reduce the burden, both in time and in fine polishing requirements, placed on the final slurry-polishing step.

Heretofore, in U.S. Pat. No. 4,644,703, which was issued on Feb. 24, 1987 to Wesley R. Kaczmarek, Eugene Zador, and Sitaramaiah Ravipati, and which is assigned to Norton Company, the Assignee of the instant application, there has been disclosed coated abrasive material suitable for use in a single step lens fining process. The product disclosed in that patent is manufactured by coating two distinct layers of an adhesive/abrasive grain slurry onto a backing member, to provide a coarse outer layer and a finer inner layer of abrasive grains. The slurry coatings are deposited by a gravure roll having a trihelical pattern cut therein which, in turn, imparts a pattern of parallel lines of adhesive/abrasive grain slurry to the backing member and, in turn, to the first deposited coating. Subsequent to application of the first coating, the backing member with the wet slurry thereon passes through a texturing bar assembly whereat the continuity of the deposited coating material, i.e., the lines of wet slurry, is broken up to provide a somewhat discontinuous pattern. Afterwards, the wet slurry coating is subjected to ultraviolet light to cure the adhesive binder and to adhere the abrasive grains to the backing member. After curing of this first slurry coating, a second adhesive/abrasive grain slurry is coated onto the first coated backing member, to provide the outer, more coarse grain, layer in the coated abrasive product. This processing is the same except that a gravure roll having a different helical pattern is used, and there is no texturing of the second applied wet slurry.

The abrasive grains, in U.S. Pat. No. 4,644,703, are adhered to the backing member, which may be a polyester film, with binder layers compounded primarily of two distinct groups of ingredients as the main components in somewhat different formulations for the respective first and second coats. The radiation curable binders, in general, comprise a mix of monomers of different functionality and an acrylated oligomer. Thus, the binders are formulated with a carefully selected combination of monomers including triacrylated monomers, e.g., trimethylolpropane triacrylate (TMPTA), and diacrylated monomers, e.g., hexanediol diacrylate (HDODA), and acrylated oligomers, the preferred being the diacrylates of epoxy resins of the bisphenol-A type, to obtain the desired combination of hardness, low degree of shrinkage, curing speed and adhesion. Importantly, also, as disclosed by the patentees, the adhesive formulations include a non-acrylic monomer, i.e., N-vinyl-2 pyrrolidone in a controlled amount. Such a monomer, among other things, promotes adhesion to the substrate, and serves as a viscosity reducer for the slurry.

In any event, the single step two-layered fining pad of U.S. Pat. No. 4,644,703 has met with only somewhat limited commercial success. Such an abrasive product must meet certain desired cut parameters and the cut performance of the two-layered fining pad has been found to be on the lower end of the required range.

Recently, there has been commercially introduced by others a further coated abrasive product for use as a single step fining pad. This product has what appears to be spherical-shaped aggregate of aluminum oxide abrasive particles (4 microns) coated onto a backing member. In use, the product is claimed to provide a high initial cut rate which is maintained because new abrasive is exposed as the aggregates wear down. Further, such product is claimed to fine a lens to a dimensionally precise surface with a pre-polish surface previously unattainable in a single fine operation. Nevertheless, although good performance may be obtained with this product, as claimed, its use is not without certain disadvantages. First, its method of manufacture necessarily incurs added cost in the use of the aggregates. These aggregates must, of course, be first manufactured, after which they are then coated onto the water-proof paper backing member. The resin used for coating of the spherical-shaped aggregates onto the backing member is a phenolic, i.e., phenol-formaldehyde. The use of such binders in and of themselves involve certain problems and disadvantages, e.g., long curing times. Importantly also is the fact that such resin binders contribute to environmental problems giving off, during curing, toxic fumes of phenol and formaldehyde. Furthermore, in use, the performance does not always seem consistent in producing the desired finish. In some cases, numerous deep scratches on the lens have resulted in use of this product.

Thus, there still remains a need for an improved single step fining pad. And, there is further a need for a system comprising a radiation curable adhesive binder which will allow manufacture of such ophthalmic coated abrasive products of good quality and in a relatively low-cost commercially satisfactory manner.

SUMMARY OF THE INVENTION

A primary object of this invention is to provide coated abrasive material suitable for use as a single step fining pad, not attendant with the problems of such pads used heretofore.

A further object is to provide a single step fining pad that not only produces good initial cut performance but also maintain such while at the same time providing a highly satisfactory prepolish surface.

Still another object of this invention is to provide a single step fining pad that is at least the equivalent in performance of that provided by the now commercially available coated abrasive material having spherical-shaped aggregates of abrasive grain adhered to a backing member.

Quite advantageously, the coated abrasive material of this invention can be manufactured using a radiation-curable resin system. Even more advantageously, the adhesive binder formulations used in the practice of this invention can be completely cured to the desired hardness with use of ultraviolet ("UV") light.

The above and other objects and advantages, as will become more clear on reading of this specification of the invention, are, in general, accomplished by providing coated abrasive material particularly engineered for single fining ophthalmic application. The coated abrasive materials of this invention are, in general, of conventional coated abrasive structure, i.e., a layer of abrasive grains adhered to a backing member by a maker coat (or adhesive binder layer) and overcoated with a size coat (or second adhesive binder layer). Nevertheless, the maker and size coats, and this is of critical importance, are each tailored to unique relative hardness and flexibility characteristics.

Quite surprisingly, we have discovered that a coated abrasive product with a substantially less hard binder system such as results from use of UV-light curable binders as disclosed herein, provides cut performance and finish in single step ophthalmic fining equivalent to that obtained by coated abrasive products having a much harder phenolic binder system.

BRIEF DESCRIPTION OF THE DRAWINGS

The invention will, it is believed, be more clearly understood by reference to the figures of the drawing wherein there is shown in.

DETAILED DESCRIPTION AND THE PREFERRED EMBODIMENTS

Figure 1:
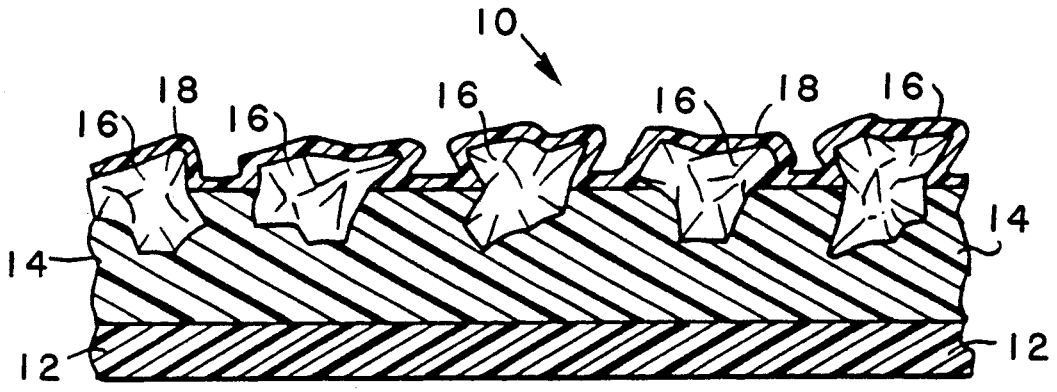
FIG. 1 a cross-section of coated abrasive material according to the invention; and in FIG. 2 is shown a plan view of a single step fining pad diecut from the coated abrasive material of FIG. 1.

Turning now to the drawing, there is shown in FIG. 1 thereof coated abrasive material 10 of conventional structural characteristics comprising a backing member 12, a maker coat (or adhesive binder layer) 14, a layer of abrasive grains 16 and a size coat (adhesive binder layer) 18.

Backing member 12 can be any of various materials conventionally used for coated abrasives provided such meets the requirements for ophthalmic single fining applications. In general, however, the backing member should be waterproof, since fining products are normally used wet. The strength of the backing member should be sufficient to resist tearing or other damage in use and the thickness and smoothness of the backing member should allow the achievement of the product thickness and smoothness range for the intended application. The adhesion of the maker coat to the backing member should be sufficient to prevent significant shedding of the abrasive/adhesive coating during normal use of the fining product. These requirements are most readily met by the use of flexible and dimensionally stable plastic films or waterproof paper as the backing member. The most preferred film backing member is a polyethylene terephthalate film. Nevertheless, other polymeric films, e.g., polycarbonate films, may also be found suitable. The backing member, if a polyester film as abovementioned, should preferably be primed or pretreated to promote adhesion between the maker coat 14 of the coated abrasive layer and the backing member 12. Various of such primed or pretreated polyester films will be found suitable in the practice of the invention, e.g. Melinex 505 polyester film from ICI Americas Inc., Hostaphon 4500 from American Hoechst Corporation, and Mylar 300XM, available commercially from E.I. DuPont de Nemours Co. Such a film is disclosed in U.S. Pat. No. 4,476,189, which issued on Oct. 9, 1984 and is entitled "Copolyester Primed Polyester Film" and in "Polyester Film for Printing", an article published in "Screen Printing", May, 1982, authored by Dr. B. Lee Kindberg, the complete disclosure in the patent and article being herein incorporated by reference.

The thickness of the backing member 12 should be sufficient to provide the strength desired for the application intended. Nevertheless, it should not be so thick as to adversely affect the desired flexibility in the coated abrasive product. Typically, the backing member should have a thickness less than about 10 mils, preferably in the range of from about 2 to 5 mils, even more preferably about 3 mils.

Maker coat 14, like size coat 18, comprises formulations that can be, most advantageously, cured to the desired hardness, as later disclosed more in detail, through a free radical mechanism induced by exposure to actinic radiation, i.e., ultraviolet ("UV") light or electron beam radiation. Quite advantageously, the maker and size coats disclosed herein, and used in the practice of this invention, can be cured to the extent deemed necessary entirely by use of UV light.

The maker coat 14, like the size coat 18, comprises a unique combination of two main groups of radiation-curable ingredients, i.e., carefully selected monomers having mono-, and multi-functionality, and acrylated oligomers. Importantly, the most preferred monofunctional monomer for use in the practice of the invention is N-vinyl-2 pyrrolidone. Such a monomer aids in providing good adhesion between the maker and size coats and abrasive grain. This apparently results from the fact that such monomer is hydrophilic as is the aluminum oxide grain used in the practice of the preferred aspects of the invention; however, we do not wish to be limited to this theory. Of importance also is the fact that the vinyl pyrrolidone monomer functions in the maker and size coat formulations as a reactive diluent whereby the desired viscosity and other rheological properties of the maker coat can be better adjusted as desired. Furthermore, the vinyl pyrrolidone monomer functions also to increase the cured film hardness in the formulations disclosed herein without causing excessive film brittleness. Such monomer readily forms copolymers with the other monomers and the acrylated oligomers, disclosed hereinafter, comprising the binder formulations, under UV-light curing. The more preferred maker coat formulations will comprise from about 15–25% by weight vinyl pyrrolidone.

The maker coat formulation should also include a monomer having mono- acrylic functionality, preferably provided by a dimer of acrylic acid. A suitable dimer of this type is commercially available from Alcolac Corp. under the trade designation "Sipomer-BCEA". Such a dimer contains appendant carboxylic acid groups important in obtaining suitable dispersions herein and good in adhesion to the preferred polyester backing member. Nevertheless, it is preferred that where such dimer is used in the formulations disclosed herein that it be in an amount no more than about 10% by weight as it copolymerizes under the conditions of cure disclosed later.

The multifunctional monomer used in the maker coat is preferably a monomer having tri- acrylic functionality. The preferred trifunctional monomer used is trimethylolpropane triacrylate ("TMPTA") as such gives rapid curing and a high cross-linked density in the cured film. Nevertheless, in some cases, difunctional acrylic monomers, e.g. 1,6 hexane diol diacrylate (HDODA) being preferred, may also be found suitable. Minor amounts of acrylated monomers with four or more acrylate groups per molecule may also be used in some cases in lieu of part of the triacrylate monomer.

With respect to the acrylated oligomers used in the maker coat, the preferred such oligomer is a diacrylated epoxy oligomer, preferably a diacrylate of an epoxy resin of the bisphenol-A type. Such diacrylated oligomers are readily available commercially under such tradenames as Novacure and Celrad from Interez, Inc., of Louisville, Ky.

The relative amounts of the various monomers and the oligomer used in the maker coat formulation will need to be adjusted along with variations in the other components included therein, as hereinafter disclosed, to give the most suitable rheological properties, in particular viscosity, for coating, as well as the most desired and effective grinding and/or finishing characteristics to the fining product of this invention. The principles governing the selection of the radiation hardenable monomers and oligomer and formulations used in the practice of this invention are deemed well known to those experienced in the art. In general, however, the tri- or higher-functional monomers are usually brittle film formers. Nevertheless, such impart a high degree of hardness and heat resistance. Mono- functional monomers, on the other hand, usually impart good flexibility but, for the most part, are slow to cure and provide low viscosity. Di-functional monomers, e.g. HDODA, are somewhat intermediate in performance between the mono-and tri- or higher-functional monomers.

Importantly, it has been discovered that, the epoxy acrylate oligomer used in the maker coat results in a cured maker film that erodes evenly in the single fining application involved and without smearing of the lens. The maker formulation need be a balance of monomers and oligomer, along with other ingredients therein, that will provide a relatively low viscosity whereby to allow the abrasive grains, later more fully disclosed to be embedded therein and properly oriented. As will be appreciated by those in the art, the maker formulation should contain as much of the oligomer as possible without its adversely effecting the desired relatively low viscosity of the maker formulation. Thus, the amount epoxy oligomer in the maker need be balanced with the other monomers therein to provide optimum viscosity for coating, as well as other properties desired in the final product.

The acrylated monomers and the dimers used in the practice of this invention, whether in the maker coat or the size coat, will be preferably unsubstituted acrylates and acrylic acid. Nevertheless, substituted acrylates such as methacrylates and substituted acid such as methacrylic acid can also be used.

The maker coat composition, and also the size coat, will also need to include a photo-initiator to initiate the cure of the radiation curable monomers. Such a photoinitiator, will need to adequately absorb and transfer to the monomeric components and oligomers, and the monofunctional vinyl pyrrolidone the energy from the UV lamps used to initiate cure. Methods for determining the amounts and types of photoinitiator used are conventional in the art of UV light cured surface coatings. The same methods have been found effective for purposes of the present invention. The amount of photoinitiator to be used is generally from about 0.5 to 7.0% by weight of the total amount of mono- and multi- functional components present in the formulation, whether maker or size coat.

The photoinitiator preferred for use in the practice of this invention is 2.2-dimethoxy-2-phenyl acetophenone (hereinafter "Irgacure 651"). However, 2-chlorothioxanthone, benzophenone, and 1-hydroxycyclohexyl phenylketone may also be used, along with many others known in the art.

Other components will also be found useful to be included in the maker and size coat compositions, e.g., coupling agents and adhesion promoters, and colorants to give a particular color to the abrasive products. Examples of adhesion promoters are the organosilanes and organotitanates containing at least one organic group with from 10–20 carbon atoms. An often preferred material, especially for products to be used for lens fining, is tetrakis [(2.2-diallyloxymethyl) 1-butoxy] titanium di(tridecyl) monacid phosphite. In the case of colorants, as with other components, care must be taken to select those which will not unduly absorb the UV light and thus interfere with curing of the radiation-curable components of the binder. As usual, in coating compositions, the maker and size coat compositions disclosed herein can also include suitable surfactants and foam suppressants.

Of critical importance in the practice of this invention, the maker coat composition will need also include a filler not only to lower the cost of such composition but most importantly to provide a suitably more hard maker coat. Such a filler needs to have certain optical absorption characteristics, i.e., be of low optical absorption, whereby not to unduly interfere with the UV light curing. A preferred filler having such characteristics is an amorphous silica commercially available under the trade designation "Silica, Velveteen R" from Tammsco Inc. Nevertheless, other fillers may be also used, e.g. other silica fillers, provided such meet the characteristics set forth herein. A Velveteen R filled maker coat has been determined to have a percent transmittance of light of 87.5, compared to 98% for an unfilled maker film, by UV spectrophotometer. Calcium carbonate, a commonly used filler in the maker and size coats used in the manufacture of coated abrasive material is much less preferred, due to its relatively low percent (72.6%) transmittance of light. Whatever the filler used in the maker formulation, however, it should preferably have an average particle size about 15 microns. In general, fillers having large proportions of relatively course particles are less preferred as such adversely affects lens finish. The filler used should be characterized by its hardness and not readily breakdown. The weight ratio of the filler to the monomers in the maker coat should be balanced to provide the desired viscosity. Nevertheless, in general, the maker coat formulation should contain as much of the filler as possible, as such provides harder films. One should keeping in mind, however, in any particular formulation, the viscosity and other requirements set forth herein. It will be appreciated also by those skilled in the art that viscosity of the maker formulation rapidly increases with additional amounts of filler. A sufficient amount of filler will need to be included in the maker and size coat formulations, however, along with a balance of the other ingredients to meet the film hardness characteristics desired herein, later more fully disclosed.

The abrasive grains 16 can be any aluminum oxide abrasive grains meeting the requirements set forth hereinafter. Primarily, the abrasive grains must have good electrostactic coating activity for orientation in an upward propulsion ("UP") field. Also, the abrasive grains need to flow freely from the grain hopper to the belt, according to usual techniques, without formulation of clumps to assure uniform abrasive grain distribution. The preferred abrasive grain is available from Micro Abrasives Corporation under the trade designation, MICROGRIT WCA #15, and is a precision graded aluminum lapping powder having a size range of from 5.1–32.0 microns, with an average size of 15.0 microns. Such abrasive has a white color, a hardness of 9.0 (Mho), a pH of 8.5, a specific gravity of 3.8 and a particle shape characterized as a hexagonal platelet. The typical chemical analysis for such abrasive grain is: $Al_2O_3$–99.20%, $SiO_2$–0.02%; $Fe_2O_3$–0.03%; $Na_2O$–0.40%, and Loss On Ignition (L.O.I.) of 0.35%. Nevertheless, other alumina abrasive grains may also be found suitable for use in the practice of this invention, provided that they meet the requirements set forth above. The abrasive grains used in the practice of this invention may contain additives, according to conventional practice, to improve their flow characteristics, e.g. silicates, and to increase electrostatic activity, e.g. antistats. Aluminum oxide abrasive grains are usually preferred because they lead to the best combination of cut and finish values. Such abrasive grains, moreover, tend to scatter light and are advantageous to the UV curing in this invention. The most preferred alumina abrasive grains found suitable in the invention are of high purity. Nevertheless, whatever the abrasive grains used, such must have adequate transmission for UV light so as not to interfere with curing of the maker and size coats.

The particle size of the abrasive grains used will, on average, be from about 12 to about 25 microns. The preferred average particle size is about 15 microns with no abrasive grain particle larger than about 45 microns, preferably no greater than about 35 microns. In general, the largest particle size should be no greater than about three times the nominal particle size.

The size coat 18, like the maker coat 14, comprises a unique combination of mono- and multi-functional components, these being necessary to obtain the desired hardness and flexibility characteristics. Nevertheless, the size coat formulation is tailored to provide a significantly harder, more brittle, binder layer than that of the maker coat. Thus, it has been quite surprisingly discovered that such differential hardness results in a coated abrasive fining product that is the equivalent at least in performance to such a product having much harder phenolic resin binder layers. This is believed indeed surprising, and moreover unexpected, in that phenolic binders give Knoop hardness in the 40–50 range, and such hardness cannot be duplicated by UV light curing systems.

The size coat, like the maker coat, comprises two main groups of radiation-curable components, namely acrylated oligomers, and a uniquely selected combination of monomers having mono- and multiacrylic functionality. The preferred oligomer for use in the size coat formulation is a hexa- functional urethane acrylate oligomer. One such an acrylate oligomer that will be found suitable is commercially available under the trade designation Ebecryl 19-6220 from Radcure Specialties, Inc., Port Washington, Wisconsin. This material is primarily a hexa-acrylated urethane oligomer reaction product of pentaerythritol tetracrylate (PETA) and toluene disocyanate (TDI) having a molecular weight of about 1000 but also contains some TMPTA. Another such hexafunctional urethane acrylate component that can also be used is available under the trade designation AB-514-50A from American Biltrite, Inc. of Lawrenceville, N.J. Such hexafunctional urethane acrylate oligomer is the reaction product of a TDI/polyester prepolymer and PETA and is similar to Ebecryl 19-6220, having a molecular weight about 1000, but contains no TMPTA. The polyester in such oligomer is of low molecular weight, desirably tripropylene glycol adipate, having a molecular weight of about 550. Such oligomer forms a relatively hard film with relatively little shrinkage. If desired, this oligomer can be diluted with about 10 per cent by weight of vinyl pyrrolidone ("V-Pyrol").

Other components in major proportions essential to the size coat formulation are TMPTA and vinyl pyrrolidone (V-Pyrol), both of which were earlier disclosed and are included in the size coat formulation for the same reasons earlier given. Included in somewhat lesser but essential amounts are hexanediol diacrylate ("HDODA") and Sipomer BCEA, the dimer of acrylic acid earlier disclosed. HODA is the preferred difunctional monomer as it imparts good curing speed, flexibility, and good "solvent" properties to the formulation. As will be readily appreciated by those skilled in the art, the size coat can comprise in any particular case, the oligomers and monomers above-disclosed in those relative amounts that will give the most optimum characteristics, e.g., hardness, flexibility, etc., desired.

The size coat formulations can include other components, as in the case of the maker coat, e.g., coupling agents, colorants surfactants, etc, commonly used in coating compositions. Such materials as selected for use should take into consideration their effect upon the UV curing to be accomplished.

Of critical importance, however, the size coat formulation will also include a suitable filler and in such amounts as to provide not only the desired hardness, but such characteristic as desired relative to the maker coat. In general, the same filler used in the maker coat formulation will be found quite satisfactory but in a somewhat lesser amount by weight.

The maker and size coat formulations are each, importantly, and this is a critical aspect of this invention, of a tailored formulation to provide the desired hardness in each of the different layers in the final product, and with respect to one another. The maker coat 14 should be, in general, a relatively more flexible and softer layer than found in conventional coated abrasive material. Conventional coated abrasive material having a phenolic-formaldehyde make/size coat will (unfilled), as earlier disclosed, have a Knoop hardness of from about 40–50. Adhesive binder layers of epoxy or polyester resins, by comparison, will have a hardness of about 25–30. Further by comparison, the maker coat layer of the present invention will, desirably, have a Knoop hardness, when measured on a Tukon Indentation Tester, according to conventional techniques, and when fully cured, of at least about 18. The Knoop hardness of the maker coat should preferably range from about 18 to about 25.

The size coat 18, on the other hand, should be, desirably, of significantly greater hardness than the maker coat and, accordingly, somewhat more brittle. Such a layer as desired in this invention, when cured, will have a Knoop hardness of at least about 25, preferably from about 30 to about 55.

The maker and size coats are, in general, deposited onto the backing member by spreading the respective liquid formulations thereof in a layer substantially uniform in thickness. This can be accomplished by any means now conventionally used, for example, doctor blade, knife coating, roll coating such as transfer roll, pressure rolls, gravure roll, etc. The preferred roll for make application is a conventional 80 Hex, R-11 gravure roll. Nevertheless, other gravure rolls, e.g., a 125 Hex, RI gravure roll, will also be found suitable. For size coat application, a conventional rubber/steel transfer roll system is preferred, having a nip opening whereby to provide 80–100 psi. The rubber roll desirably will have a hardness of about 75 Shore-A Durometer. In general, the preferred coating speed for the maker coat will range from about 40–60 feet/min. The coating speed for the size coat should preferably be in the range of about 30–50 ft./min.

The abrasive grains are coated onto the maker coat by conventional electrostatic propulsion techniques or by gravity deposition. Preferably, upward propulsion is used to propel and orient the grain according to usual techniques. The abrasive grains, in general, are propelled upwards from a moving belt, onto and embedded in the maker coat while it is still wet and, in such a way that the grains are substantially uniformly distributed over the maker coat.

Subsequent to application of the abrasive grains to the still wet maker coat, the wet coated web or backing member is then immediately subjected to cure by UV light. The amount of such radiation should be sufficient to, in general, fully cure or harden, i.e. solidify, the adhesive binder layers. Nevertheless, in some cases, it may be more desirable to provide less than a complete cure to the maker coat, until after application of the size coat. On application of the size coat, the size coat will then be subjected to UV light curing and the coated abrasive material then wound into rolls according to conventional practice. The radiant power of the UV light source should provide an output of from about 200 to about 300 watts per inch of width of backing member. Such UV power sources are readily available commercially.

The relative amounts of the various ingredients in the maker and size coat formulations will be selected, as earlier disclosed, to provide coated abrasive material of the desired hardness and flexibility, and to give the desired rheological properties, i.e., viscosity, for best application of the formulations by whatever method of coating is utilized. In general, the viscosity for the maker coat should be from about 400 cps to about 700 cps, at 75° F. Such a low viscosity in the maker formulation is necessary to embed the oriented abrasive grains. The viscosity of the size coat should, at 75° F., be from about 100 cps to about 300 cps.

The weight of maker and size coats applied to the backing member can vary somewhat. Nevertheless, in general, the maker coat add-on weight should be from about 0.8 to about 1.2 lbs./ream. The preferred weight for the size coat is from about 0.6 to about 1.0 lbs./ream. A ream is equivalent to 330 square feet of coating area. Whatever the amount of either coat applied, it should be sufficient to hold the abrasive grains in place. The grain weight should be in the range of from about 3.5–5.0 lbs./ream. The thickness of each of such binder layers should be uniform.

The preferred embodiments of the present invention may be further appreciated from the following examples. All preparations set forth herein are to be understood as being based upon mass or weight, unless otherwise stated.

EXAMPLE No. 1

Coated Abrasive Product Suitable for Single Fining Ophthalmic Applications

The components listed below, except for the coloring agent and filler were readily mixed together without special care to form a "clear liquid". About three-fifths of this clear liquid was then separately mixed with the coloring agent for at least 15 minutes to assure thorough mixing; the remainder of the clear liquid was then added and mixed until uniform color was achieved. Then, the filler was added last, only as a matter of convenience. Nevertheless, there is no reason why the ingredients cannot be added to the mixer in the order set forth, beginning with the Novacure 3702. Mixing was accomplished in a conventional hi-shear mixer, using a Cowles type blade.

| Ingredients | Amount |
|---|---|
| Novacure 3702[1] | 7000 |
| TMPTA[2] | 5600 |
| V-Pyrol[3] | 3200 |
| Sipomer BCEA[4] | 1200 |
| Penn Color 9R-75[5] | 400 |
| FC-171[6] | 40 |
| KR-55[7] | 64 |
| BYK A-510[8] | 64 |

-continued

| Ingredients | Amount |
|---|---|
| Irgacure 651[9] | 640 |
| Velveteen R[10] | 1000 |

1. Novacure 3702 is available commercially from Interez, Inc. and is a diacrylated ester of a bisphenol A type epoxy resin modified with fatty acid ester groups, having a maximum acid value of 3 and a weight per epoxide of 1600 (min.).
2. Trimethylolpropane triacrylate (TMPTA) is available from Interez, Inc.
3. V-Pyrol (vinyl pyrrolidone) was supplied by GAF Corporation.
4. Sipomer BCEA is a dimer of acrylic acid available from Alcolac Corp.
5. Penn Color 9R-75, available from Penn Color, gives the product a purple color. Other colors could also be used, if desired.
6. FC-171, available from 3M Company, is a fluorocarbon surfactant.
7. KR-55, available from Kenrich Petro Chemicals, Inc., is tetra (2.2 diallyloxymethyl-1-butoxy) titanium di (ditridecyl phosphite).
8. BYK A-510, available from BYK MallinKrodt Company, is a solvent containing bubble breaker (foam suppressant).
9. Irgacure 651, available from Ciba Geigy Co., is a photoinitiator.
10. Silica, Velveteen R is an amorphous silica filler (3–4 microns in size) available from Tammsco Inc. of Tamms, Illinois, having the composition:
Silica 97.74%
Aluminum Oxide 0.46%
Ferric Oxide 0.08%
Calcium Oxide 0.91%
Magnesium Oxide 0.14%
Ignition Loss 0.59%
A specific gravity of 2.56, pH of 7, and a hardness of 7 (Moh's).

The viscosity of this formulation at 76° F. was determined to be 650 cps (Brookfield viscometer, spindle #2, at 30 rpm).

This formulation was applied by means of an 80-Hex, R-11 gravure roll to a 3 mil polyester film pretreated to increase adhesion of the maker coat thereto (Melinex 505 polyester film), at a coating weight of about 1.0 lbs./ream. The speed of the roll was maintained so that the roll periphery matched the linear speed of the backing member. Such a gravure roll or cylinder is available commercially from Consolidated Engravers, Corp. It is well known in the art of gravure printing that in such designation 80 refers to the number of cells, in this case hexagonal-shaped, per linear inch and R-11 denotes the particular tool that was used to generate the cells. This latter number is related to cell depth and thus the combination 80 Hex and R-11 defines a particular cell shape as well as cell volume. The total theoretical cell volume of this particular roll is $22.1\times10^9$ cubic billion microns-/inc.$^2$. Each cell has a depth of 0.0049 inches. Other manufacturers, however, produce rolls having the same or a similar pattern, and such will also be found useful.

Next, while in horizontal travel, aluminum oxide abrasive grain (MICROGRIT WCA #15) was applied to the maker coat, according to usual upward propulsion techniques. The abrasive grains had an average size of about 15 microns and provided an add on weight of about 4.2 lbs./ream.

The wet coated backing member was then exposed to the output of conventional UV mercury vapor lamps having a radiant power output of about 300 watts per inch of width. Under these conditions, the radiation-curable maker coat was incompletely cured.

A size coat was then overcoated on the abrasive grains according to usual technique using a rubber/steel transfer roll combination to provide an add-on weight of about 0.8 lbs./ream. The following ingredients were mixed together to provide the size coat:

| Ingredients | Amount |
|---|---|
| AB-514-50A[1] | 5550 |
| TMPTA | 4050 |
| HDODA[2] | 300 |
| V-Pyrol | 3150 |
| Sipomer BCEA | 1050 |
| Penn Color 9R-75 | 300 |

-continued

| Ingredients | Amount |
|---|---|
| KR-55 | 48 |
| FC-171 | 15 |
| BYK A-510 | 48 |
| Irgacure 651 | 480 |
| Velveteen R | 750 |

1. AB-514-50A is a hexacrylated urethane oligomer available from American Biltrite, Inc.
2. HDODA is hexanediol acrylate available from Interez, Inc.

1. AB-514-50A is a hexacrylated urethane oligomer available from American Biltrite, Inc.

2. HDODA is hexanediol acrylate available from Interez, Inc.

The ingredients for the size coat were mixed together in the order above given. The viscosity was determined to be about 130 cps, at 82° F., using a Brookfield viscometer.

Following application of the size coat, the wet layer was again exposed to UV light, as before, to provide complete cure of the maker and size coat layer.

The maker coat was determined to have an average Knoop hardness of about 22; the average hardness of the size coat was determined to be about 32 measured from the top. The hardness of the maker coat was determined by measuring the hardness at the top as well as at the bottom of a cured free-standing film sample. When these measurements were substantially equal, such indicated complete curing of the maker layer. The film sample had a thickness of about 5 mils.

Figure 2:
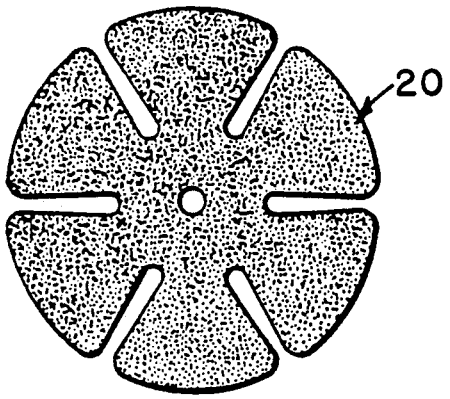

Snowflake fining pads, i.e., pads 20, having the shape shown in FIG. 2, were cut from this coated abrasive material, according to usual techniques. Afterwards, the fining pads were tested on a conventional Coburn Model-505 ophthalmic finishing machine using the standard single-step fining procedure to complete the fining of a spherical, 6.25 diopter, 65 mm diameter, CR-39 plastic lens. The pads were mounted in usual manner by pressure-sensitive adhesive to the lapping tool backup structure described in the Stith patent cited earlier. The initial thickness of the lens blank was measured according to usual techniques and the lens clamped in position. The pressure urging the coated abrasive lapping tool against the lens blank was adjusted to 20 psi. The machine was then operated for three minutes. During that time the lens and lapping tool were flooded with water.

The criteria prescribed for a successful result of this test for single fining applications are: (1) removal in the range of from about 4.5 to about 6.0 ($\times10^{-1}$) mm from the center of the lens; (2) a lens surface finish of from about 6–12 Ra and not more than about 50–100 Rt (depth for the deepest single scratch within a standard traversal rang of the surface measuring instrument); (3) general uniformity of the lens surface, and (4) lack of appreciable shedding of the coating of the coat abrasive lapping tool.

Nevertheless, cumulative stock removal, not just total cut is also important. Thus, during the first minute, the single fining pad should cut from about 1.5 to about 2.5 ($\times10^{-1}$ mm); the second minute from about 1.0 to about 1.5 ($\times10-1$ mm); and during the third minute from about 1.0 to about 1.5 ($\times10^{-1}$ mm).

The lens was removed as needed, according to usual techniques, for determination of cumulative cut, and final thickness was measured to determine the total cut. Finish was determined with a Surtronic 3 instrument, according to conventional techniques.

Snowflake fining pads cut from commercially available coated abrasive material, as earlier disclosed, having aggregates of abrasive provided thereon were used as a control. These pads were tested on the Coburn Model-505 ophthalmic finishing machine in the same manner as the product according to this invention and abovedescribed.

The results of the two tests, comparing Snowflake single step fining pads from the two different coated abrasive materials, are shown in Table I below:

TABLE I

| Comparison of Performance Between Snowflake Pads | | | | |
|---|---|---|---|---|
| Fining Pad | Finish | | Total | Quality |
| Material | Ra | Rt | Cut[1] | Erosion |
| Control Abrasive (Aggregate Containing) | 10–13 | 72–93 | 5.7 | None |
| Invention | 11 (avg.) | 77–82 | 5.6 | None |

1. Total cut = value given $\times 10^{-1}$ mm.

The cut shown in Table I above is total cut. During the three minute test the control cut was 2.7 (1 min.); 4.4 (2 min.) and 5.7 (3 min.). By comparison, the cut for the single step fining pad according to the invention was 2.3 (1 min.); 4.2 (2 min.) and 5.6 (3 min.).

As indicated by the above, the Snowflake pad obtained from the coated abrasive material according to the invention, and that manufactured from the aggregate abrasive material are equivalent in performance. Most importantly, however, the single step fining pad according to the invention substantially meets the requirements for such application. Accordingly, satisfactory cut rate and fine lens finishes can be obtained from non-aggregate abrasive grain containing coatings of the present invention leading to substantial reduction in manufacturing cost of abrasive material for production of such Snowflake pads.

The performance of a candidate material for ophthalmic lens single step fining is usually defined in terms of the quality of finish generated consistently together with the presence or absence of signs of erosion of the coated abrasive on the used fining pad. Erosion or removal of the coating from small areas, especially at the edges of a fining pad, is usually taken as a sign of non-reliable product performance. Coatings that show erosion are normally rejected. Lens finish quality is commonly measured by the Ra and Rt values taken from traces at various spots (e.g. at the center and at the left, right edges) along the finished lens. The meaning of these statistical parameters is well known to those skilled in the art. Such are clearly defined in a publication entitled "An Introduction to Surface Texture and Part Geometry" by Industrial Metal Products Incorporated (IMPCO), the complete disclosure of which is incorporated herein by reference. In general, Ra is a measure of average surface roughness. Since many surfaces of differing topography might yield similar Ra values, this number is usually supplemented by other parameters generated from the same surface. In the ophthalmic finishing art, Rt is often employed to supplement the Ra measurement. The value of Rt is a measure of the depth of gouges or scratches that might remain on the lens surface after fining. These scratches must be removed from the lens surface in the slurry-polishing process.

EXAMPLE 2

Performance of Single Step Pad With and Without Compensation Builder

In use, the thickness of the coated abrasive material, i.e., fining pad, is built up by the user prior to installation on the grinding machine. Such a buildup, or additional backing layer provides a cushioning layer to the fining pad. Various materials are used by those in the ophthalmic grinding art to provide this builder or compensating layer, and such forms no part of this invention. Nevertheless, an internal test was devised to compare the results of an internally compensated fining pad with a pad provided to an actual user. The builder used in this example by the inventors was a 10 mil layer of polypropylene, such being adhesively secured to the backing member of the fining pad prior to application to the Coburn fining machine. The fining pads were die-cut from coated abrasive material like that in Example 1. The results are shown in Table 2.

TABLE 2

| Comparative Performance of Compensated Single Fining Pad | | |
|---|---|---|
| Product | Cumulative Cut And Total ($\times 10^{-1}$ mm) | Finish |
| Control | 2.0; 3.9; 5.4 | Ra = 10; Rt = 73–84 |
| Invention | 2.2; 3.8; 5.1 | Ra-10–11; Rt = 80–90 |

In neither tests was there any erosion experienced.

Thus, it is seen that the single fining pad of the invention when compensated for use provides satisfactory performance in both cut and finish.

EXAMPLE 3

Performance of Single Step Fining Pads According To Invention Compared Against Dispersion Coating In this example, a number of different dispersion coatings of abrasive grain in the following adhesive formulation was evaluated:

| Ingredients | Weight/gms. |
|---|---|
| Novacure 3600 | 1100 |
| TMPTA | 1320 |
| HDODA | 600 |
| V-Pyrol | 600 |
| Irgacure 651 | 180 |
| Violet 9R-75 | 100 |
| KR-55 | 10 |
| FC-171 | 20 |
| BYK A-510 | 20 |

Type 18-S (Norton) abrasive grains of alumina having an average particle size of 15 microns was dispersed in the above binder composition in grain: resin ratios varying 2.0; 2.5; and 2.75.

These dispersions had viscosities of 2,000 cps, 6,000 cps, and 12,000 cps, respectively. Each were coated onto a 3 mil polyester film back member. The amount slurry applied was 2.1 #/ream, 2.0 #/ream, and 2.4 lbs/ream, respectively. The wet resin layers were cured by UV light.

Snow flake pads were die-cut from the coated abrasive material and tested as before. Unsatisfactory results were obtained, indicating the criticality of the conventional coated abrasive structure and the differential hardness of the maker and size coat layers.

Although the invention has been particularly disclosed for use in grinding CR-39 plastic lenses, it will be appreciated that such is not necessarily so limited. Satisfactory results may also be found when using the fining pads of the invention on lenses of different materials, sizes and shapes.

The foregoing detailed description has been given for clearness of understanding only and no unnecessary limitations are to be understood therefrom. The invention is not limited to the exact details shown and described for obvious modifications and variations will now occur to those skilled in the art without departing from the spirit and scope of the invention as described in the following claims.

What is claimed is:

1. A coated abrasive material suitable for use as a single step fining pad comprising:

a flexible and dimensionally stable backing member;

an abrasive adhered to one surface of said backing member by a maker coat adhered to said backing member; and an ultraviolet radiation-cured size coat overlying said abrasive grains and further adhering said abrasive grains to the maker coat, said size coat comprising a multifunctional urethane oligomer reinforced with an ultraviolet radiation transparent particulate filler having a hardness at least as great as silica.

2. Coated abrasive material according to claim 1 wherein the maker coat formulation comprises as its main ingredients a combination of radiation curable monomers having mono- and multi-functionality selected from the group consisting of N-vinyl-2 pyrrolidone, and monomers having di- and tri acrylic functionality, and an acrylated oligomer.

3. Coated abrasive material according to claim 2 wherein the acrylated oligomer is a diacrylated epoxy oligomer of the bisphenol-A type.

4. Coated abrasive material according to claim 3 wherein the monomer having diacrylic functionality is a dimer of acrylic acid and the monomer having triacrylic functionality if trimethololpropane triacrylate.

5. Coated abrasive material according to claim 1 wherein the size coat formulation comprises as its main ingredients a combination of radiation curable monomers having mono- and multi-functionality selected from the group consisting of vinyl pyrrolidone and monomers having di-, and tri-acrylic functionality, and an acrylated oligomer.

6. Coated abrasive material according to claim 5 wherein the acrylated oligomer is a hexacrylated urethane oligomer.

7. Coated abrasive material according to claim 5 wherein the said acrylated oligomer comprises 105 by weight N-vinyl-2, pyrrolidone.

8. Coated abrasive material according to claim 1 wherein the maker and size coat formulations each further include a filler.

9. Coated abrasive material according to claim 8 wherein the filled binder layers have relatively good light transmission compared to that of an unfilled layer.

10. Coated abrasive material according to claim 9 wherein the percent light transmittance of the filled binder layers is no less than about 85%.

11. Coated abrasive material according to claim 10 wherein the said filler has the hardness of silica.

12. Coated abrasive material according to claim 1 wherein the abrasive grains are of aluminum oxide.

13. Coated abrasive material according claim 12 wherein the particle size of the abrasive grains ranges from about 12 to about 25 microns.

14. Coated abrasive material according to claim 13 wherein the abrasive grain particle size is about 15 microns.

15. Coated abrasive material according to claim 1 wherein the said radiation-cured maker coat is characterized by a Knoop hardness of from about 18 to about 25, and the radiationcured size coat is characterized by a Knoop hardness in the range of from about 30 to about 55.

16. Coated abrasive material according to claim 1 wherein the abrasive grains are of white aluminum oxide . an average particle size of about 15 microns.

17. Process for the manufacture of coated abrasive material suitable for use as a single step fining pad comprising the following steps:

(a) providing a maker coat having as the main ingredients a combination of radiation curable monomers having mono- and multi-functionality and an acrylated oligomer;

(b) applying said maker coat onto a backing member;

(c) applying a layer of abrasive grains to said maker coat by electrostatic means whereby to properly orient the abrasive grains for best cutting and finishing performance;

(d) at least partially curing said maker coat by a suitable UV light source;

(e) providing a size coat having as its main ingredients a combination of radiation curable monomers having mono- and multi- functionality and an acrylated urethane oligomer;

(f) applying said size coat to said layer of abrasive grains and curing said maker and size coats whereby to provide a layer having a Knoop hardness greater than that of the maker coat.

18. Process according to claim 17 wherein the abrasive grains have relatively high electrostatic activity and such grains are applied to the maker coat by upward propulsion electrostatic means.

19. Coated abrasive material according to claim 1 wherein the said backing member is a polyester film.

20. Process according to claim 18 wherein the maker coat formulation comprises in combination monomers of N-vinyl-2 pyrrolidone, a dimer of acrylic acid, trimethylolpropane triacrylate, and an oligomer of a diacrylated epoxy oligomer of the bisphenol-A type and the size coat formulation comprises in combination monomers of N-vinyl-2 pyrrolidone, a dimer of acrylic acid, 1,6 hexanediol acrylate, trimethylolpropane triacrylate, and an oligomer of a hexacrylated urethane oligomer.

21. Process according to claim 20 wherein the weight of maker and size coats applied is in the range of from about 0.8 to about 1.2 lbs./ream and in the range of from about 0.6 to about 1.0 lb./ream, respectively, and the abrasive grains are of alumina oxide having a particle size in the range of from about 12 to 25 microns, and the weight of abrasive grains applied is in the range of from about 3.6 to about 5.0 lbs//ream.

22. Process according to claim 20 wherein the viscosity of the maker coat is in the range of from about 400 cps to about 700 cps at 75° F., and the viscosity of the size coat is from about 100 cps to about 300 cps, at 75° F.

23. A coated abrasive material as recited in claim 1 wherein said maker coat is relatively soft and flexible while said size coat is comparatively hard and brittle.

* * * * *

UNITED STATES PATENT AND TRADEMARK OFFICE

CERTIFICATE OF CORRECTION

PATENT NO. : 5,011,513

DATED : April 30, 1991

INVENTOR(S) : Eugene Zador, Shyiguei Hsu, Wesley R. Kaczmarek, Sitaramaiah Rivapati, Stanley Supkis & Richard H. Vogel It is certified that error appears in the above-identified patent and that said Letters Patent is hereby corrected as shown below:

Column 15, line 53 (claim 7), change the word "105" to --10%--.

Column 16, line 15 (claim 16), insert between the words "oxide" and "an" the word --having--.

Signed and Sealed this

Eighth Day of September, 1992

*Attest:*

DOUGLAS B. COMER

*Attesting Officer*

*Acting Commissioner of Patents and Trademarks*